United States Patent [19]

Guzzini

[11] Patent Number: 4,742,440

[45] Date of Patent: May 3, 1988

[54] LIGHTING DEVICE WITH ASYMMETRICAL LIGHT BEAM

[75] Inventor: Giannunzio Guzzini, Recanati, Italy

[73] Assignee: iGuzzini Illuminazione S.p.A., Recanati, Italy

[21] Appl. No.: 64,886

[22] Filed: Jun. 22, 1987

[30] Foreign Application Priority Data

Jul. 29, 1986 [IT] Italy ..... 22672[U]

[51] Int. Cl.[4] ..... F21V 7/00

[52] U.S. Cl. ..... 362/346; 362/282

[58] Field of Search ..... 362/319, 282, 346, 350, 362/284, 263, 322, 347, 433

[56] References Cited

U.S. PATENT DOCUMENTS

| | | | |
|---|---|---|---|
| 2,611,073 | 9/1952 | Wheat | 362/284 |
| 2,945,945 | 7/1960 | Rex | 362/350 |
| 4,177,504 | 12/1979 | Henderson, Jr. et al. | 362/282 |
| 4,338,655 | 7/1982 | Gulliken et al. | 362/346 |
| 4,349,866 | 9/1982 | Molnar | 362/263 |
| 4,475,147 | 10/1984 | Kristofer | 362/319 |

*Primary Examiner*—E. Rollins Cross

*Attorney, Agent, or Firm*—Hedman, Gibson, Costigan & Hoare

[57] ABSTRACT

Lighting device with an asymmetrical light beam, of the type essentially constituted by a main conical reflector on whose side wall at least an opening is provided, in correspondence of which an additional reflector segment is externally provided, characterized in that said additional reflector segment has the same curvature of the main reflector, and is fastened onto said lighting device by means of a bracket capable of holding said supplementary reflector segment spaced apart from said main reflector.

5 Claims, 2 Drawing Sheets

LIGHTING DEVICE WITH ASYMMETRICAL LIGHT BEAM

The object of the present invention is a lighting device with an asymmetrical light beam.

Lamps and lighting devices are known, which have sloping light beams, such as, e.g., from the Italian patent application No. 987,264 in the name of firm ERCO. In such patent application, an irradiation lamp is disclosed, wherein, on the peripheral surface of the main cone-shaped reflector at least an opening is provided, in correspondence of which a supplementary reflector is externally provided, having a curvature different from that of the main reflector, said supplementary reflector being so fixed that on the upper part it rests against said main reflector, and on the lower part it rests on a radial flange of said lamp.

Such solutions involves disadvantages of not only economical character, in that reflector pieces having different curvatures must be provided, and hence different types thereof must be manufactured.

A purpose of the present invention is to obviate the disadvantages which the lighting devices of the prior art still show.

A further purpose of the invention is that of supplying a lighting device capable of supplying the required brightness in any areas of a side wall to be lightened.

In view of such purposes, according to the present invention a lighting device has been provided, which has an asymmetrical light beam, of the type essentially constituted by a main conical reflector on whose side wall at least an opening is provided, in correspondence of which an additional reflector segment is externally provided, characterized in that said additional reflector segment has the same curvature of the main reflector, and is fastened onto said lighting device by means of a bracket capable of holding said supplementary reflector segment spaced apart from said main reflector.

Figure 1:
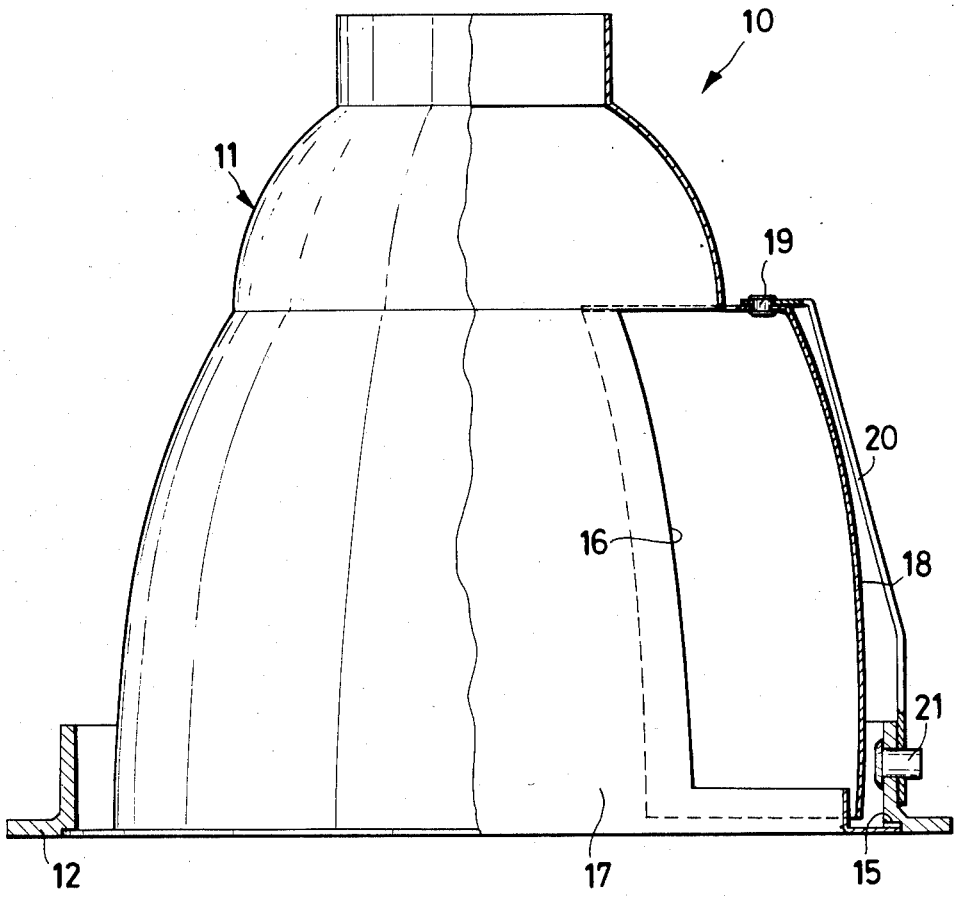
Figure 2:
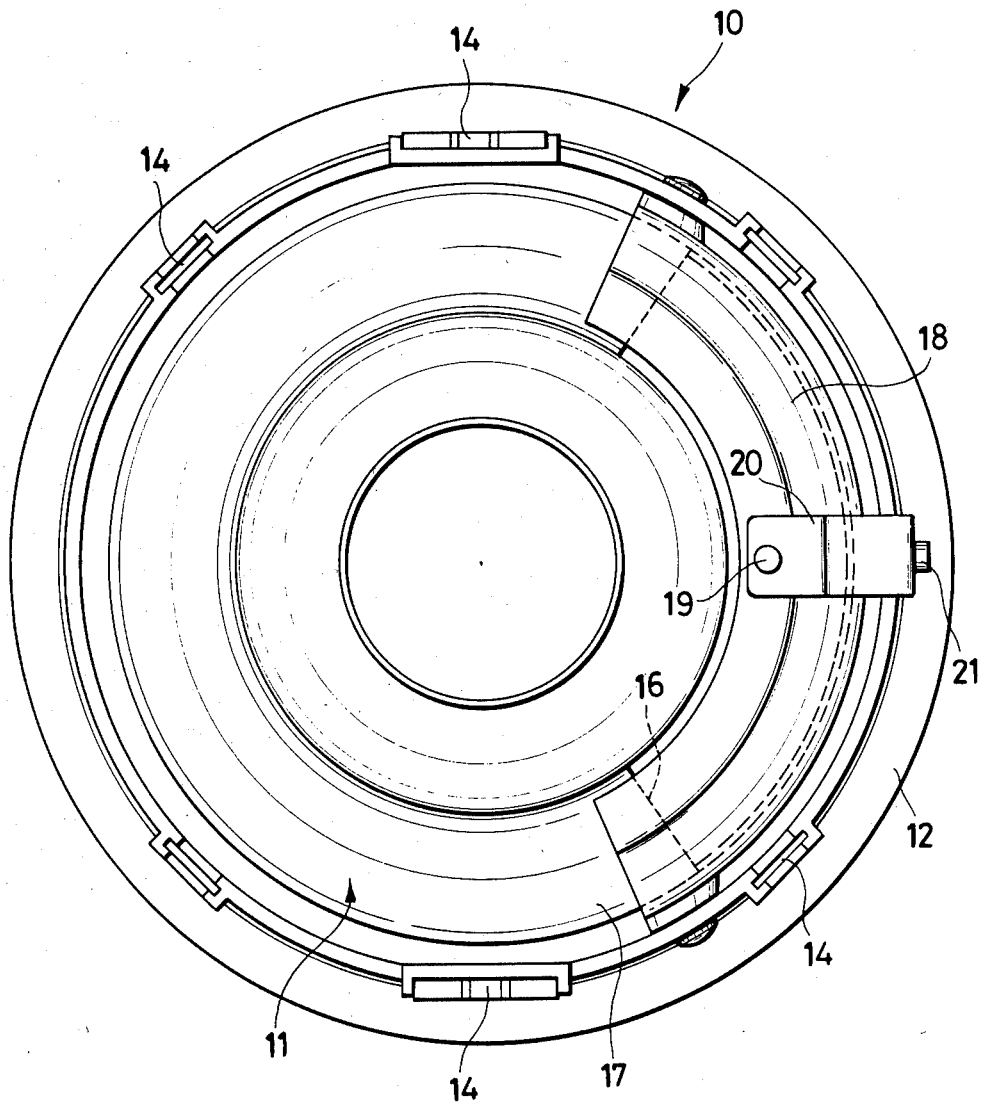

For the purpose of better understanding the characteristics and further advantages thereof, the present invention is now disclosed by referring to the figures of the hereto attached draing tables, wherein:

FIG. 1 is a partially sectional elevation view of an device according to the invention, and FIG. 2 is a plan view of the device of FIG. 1.

Referring to the figures, with 10 a reflector according to the invention is generally indicated, which is constituted by a main conical reflector 11, a support structure 12 and a supplementary reflector segment 18. The main reflector 11 is fastened onto the support structure, from which it is independent before the assemblage, by means of springs 14. The reflector 11 is furthermore provided with a reference element 15 in such a way that, when it is assembled onto the support structure, an opening 16 thereof, provided on its side surface 17, coincides with a supplementary reflector segment 18.

Such segment 18, mounted by means of first rivets 19 on a bracket 20, has the same curvature of the main reflector 11, but it can have different slopes, according to the lightening requirements.

The bracket 20, fastened to the support structure 12 by means of second rivets 21, operates in such a way that the supplementary reflector segment does not have any points of contact with the main reflector 11 and is hence completely disengaged from it.

One can easily realize how such type of lighting device can also have more than one opening on the side surface of the main reflector, for the purpose of diffusely lighting up the intended areas.

Furthermore, advantageously according to the present invention, a greater possibility of control of the light beam is obtained by properly selecting the slope of the additional reflector segment.

The present invention has been disclosed for illustrative and non limitative purposes, and it must be understood that modifications and variations can be supplied by those skilled in the art without however going out of the protection purview of the present patent application.

I claim:

1. Lighting device with an asymmetrical light beam, of the type essentially constituted by a main conical reflector on whose side wall at least an opening is provided, in correspondence of which an additional reflector segment is externally provided, characterized in that said additional reflector segment has the same curvature of the main reflector, and is fastened onto said lighting device by means of a bracket capable of holding said supplementary reflector segment spaced apart from said main reflector.

2. Lighting device according to claim 1, characterized in that said additional reflector segment is integral with the support structure for said device.

3. Lighting device according to claim 1, characterized in that said main reflector is independent from said support structure and is freely removable from it.

4. Lighting device according to claim 1, characterized in that said main reflector is fastened onto said support structure by means of fit-in springs.

5. Lighting device according to claim 1, characterized in that said main reflector is provided with a reference suitable to get positioned inside said support structure in such a way that said at least one opening provided on said main reflector comes in correspondence of said supplementary reflector segment.

* * * * *